US005575873A

United States Patent [19]

Pieper et al.

[11] Patent Number: 5,575,873

[45] Date of Patent: Nov. 19, 1996

[54] ENDLESS COATED ABRASIVE ARTICLE

[75] Inventors: Jon R. Pieper, Lindstrom; Donald C. Heinn, Maplewood, both of Minn.; Eric G. Larson, Lake Elmo, Wash.; Thomas E. Boettcher, Hastings, Minn.

[73] Assignee: Minnesota Mining and Manufacturing Company, St. Paul, Minn.

[21] Appl. No.: 740,706

[22] Filed: Aug. 6, 1991

[51] Int. Cl.[6] ..... B32B 31/00

[52] U.S. Cl. ..... 156/153; 156/159; 156/258; 156/275.5; 156/304.5; 156/304.6

[58] Field of Search ..... 156/275.5, 258, 156/153, 159, 157, 304.1, 304.5, 304.6

[56] References Cited

U.S. PATENT DOCUMENTS

| | | | |
|---|---|---|---|
| 2,668,133 | 2/1954 | Brophy et al. | 156/275.5 |
| 3,154,897 | 11/1964 | Howard . | |
| 4,011,358 | 3/1977 | Roelofs . | |
| 4,082,521 | 4/1978 | McGarvey . | |
| 4,194,618 | 3/1980 | Malloy . | |
| 4,525,959 | 7/1985 | Ziebarth et al. | 51/391 |
| 4,547,204 | 10/1985 | Caul . | |
| 4,644,703 | 2/1987 | Kaczmarek et al. | 51/401 |
| 4,652,274 | 3/1987 | Boettcher et al. . | |
| 4,735,632 | 4/1988 | Oxman et al. . | |
| 4,751,138 | 6/1988 | Tumey et al. . | |
| 4,773,920 | 9/1988 | Chasman et al. . | |
| 4,826,508 | 5/1989 | Schwartz et al. | 51/293 |
| 4,880,486 | 11/1989 | Maeda | 156/275.5 X |
| 4,891,272 | 1/1990 | Ciaccia | 428/489 |
| 4,903,440 | 2/1990 | Larson et al. . | |
| 4,999,136 | 3/1991 | Su et al. | 252/512 |

FOREIGN PATENT DOCUMENTS

| | | |
|---|---|---|
| 0142140 | 5/1985 | European Pat. Off. . |
| 0344529 | 12/1989 | European Pat. Off. . |
| 52-65391 | 5/1977 | Japan . |
| 1103240 | 12/1966 | United Kingdom . |

OTHER PUBLICATIONS

"UV Curing Improves Production Efficiency" *Adhesives Age*, Apr., 1991.

Grant & Hackh's *Chemical Dictionary* 5th Ed., McGraw-Hill, 1987, p. 579.

European Search Report.

*Primary Examiner*—Mark A. Osele

*Attorney, Agent, or Firm*—Gary L. Griswold; Walter N. Kirn; Daniel R. Pastirik

[57] ABSTRACT

Endless coated abrasive articles having a splice. In general, the coated abrasive articles comprise a backing having abrasive grains bonded thereto by one or more layers of binder. This invention also provides a method of making the splice by using radiation curable adhesives, e.g., acrylated urethanes, and radiation energy to cure the adhesives. The radiation curable splice adhesive essentially solvent-free. Consequently, the time required for the solvent to flash off is eliminated and solvent removal is no longer an environmental concern. By utilizing a source of radiation energy, the splice adhesive can be solidified in less than one minute. Because the splice adhesive is fully solidified, coated abrasive belts can be packaged immediately after the splice is formed.

47 Claims, 3 Drawing Sheets

ENDLESS COATED ABRASIVE ARTICLE

BACKGROUND OF THE INVENTION

1. Field of the Invention

This invention relates to endless coated abrasive articles, in particular, coated abrasive belts having a splice made by means of radiation curable adhesives.

2. Discussion of the Art

The conventional method for making an endless coated abrasive article, i.e., a belt, involves the steps of cutting a coated abrasive sheet to the desired length, applying a splice adhesive over both cut ends of the side of the coated abrasive sheet not bearing abrasive, allowing the coated abrasive sheet to stand for a sufficient time to allow the solvent to flash off from the adhesive, abutting the two cut ends of the coated abrasive sheet to form a joint, applying a splice medium over the joint, and solidifying the splice adhesive. The splice adhesive is typically solidified by heat and pressure.

Polyurethane splice adhesives, which are in common use, are partially cured by heat and then are fully cured over time at room temperature to effect solidification. However, cure time can take up to several days, thereby requiring the coated abrasive belt to be handled with care.

The time required for the solvent to flash off can range anywhere from five to 60 minutes, thereby creating a bottleneck in the manufacturing process. Furthermore, removal of the solvent gives rise to environmental concerns.

Polyurethane adhesives are described in U.S. Pat. No. 4,082,521 (McGarvey), which discloses a splice adhesive selected from the group consisting of polyurethane, epoxy, nylon-epoxy, and nylon-phenolic adhesives; U.S. Pat. No. 3,154,897 (Howard), which discloses a splice adhesive selected from the group consisting of polyurethanes, bisamide, polyesters, epoxy polyesters, epoxy polyamides, bisketones, diacrylates, styrene-polyesters, and the like; and U.S. Pat. No. 4,194,618 (Malloy), which discloses a urethane-based splice adhesive film that does not have a solvent associated with it. However, the process described in this patent is complex and requires a lengthy period of drying.

There are two major types of splices for endless coated abrasive sheets, the butt splice and the lap splice. In the butt splice, two ends of the coated abrasive sheet abut. The ends are held together by a splice adhesive, with a splice medium overlying the splice adhesive and the two ends. A splice medium can be a reinforced polymeric film, a woven fabric, or the like. In the lap splice, one end of the coated abrasive sheet overlaps the other end, such that the abrasive bearing side of one is in contact with the side of the other not bearing abrasive. The ends are held together by a splice adhesive alone; generally, there is no splice medium as in a butt splice.

SUMMARY OF THE INVENTION

This invention provides endless coated abrasive articles having a splice. In general, the coated abrasive articles comprise a backing having abrasive grains bonded thereto by one or more layers of binder.

This invention also provides a method of making the splice by using radiation curable adhesives, e.g., acrylated urethanes, and radiation energy to cure the adhesives.

An endless coated abrasive article having a butt splice can be prepared by first cutting a coated abrasive sheet to the desired length, then coating portions of the two cut ends of the sheet on the side not bearing abrasive with a radiation curable adhesive, abutting the two cut ends of the coated abrasive sheet to form a joint, placing a splice medium over the joint and in contact with the portions of the cut ends bearing the radiation curable adhesive, and curing the splice adhesive by means of a radiation energy to form a butt splice. In a variation of this method, the two cut ends can be abutted before the splice adhesive is applied to the appropriate portions thereof. In still another variation of this method, the splice adhesive can be coated on the splice medium instead of on portions of the side of the coated abrasive sheet not bearing abrasive. This embodiment of the invention is advantageous because it can be readily automated.

An endless coated abrasive article having a lap splice can be prepared by first cutting a coated abrasive sheet to the desired length, preferably grinding a portion of one of the cut ends of the abrasive bearing side in the region where the lap splice will be formed, preferably scuffing a portion of the other cut end of the side not bearing abrasive in the region where the lap splice will be formed, coating a portion of the cut end not bearing abrasive with a radiation curable adhesive, overlapping and contacting the two cut ends of the coated abrasive sheet such that the scuffed portion of the side of the cut end not bearing abrasive is in contact with the ground portion of the abrasive bearing side of the other cut end, so that the adhesive is inserted between the overlapping ends, and curing the splice adhesive with radiation energy.

The present invention provides a radiation curable splice adhesive that is essentially solvent-free. Consequently, the time required for the solvent to flash off is eliminated and solvent removal is no longer an environmental concern. By utilizing a source of radiation energy, the splice adhesive can be solidified in less than one minute. Because the splice adhesive is fully solidified, coated abrasive belts can be packaged immediately after the splice is formed.

DETAILED DESCRIPTION

As used herein, the "front side" of a coated abrasive article refers to the side of the article bearing the abrasive grains; the "back side" of a coated abrasive article refers to the side of the article not bearing the abrasive grains.

Figure 1:
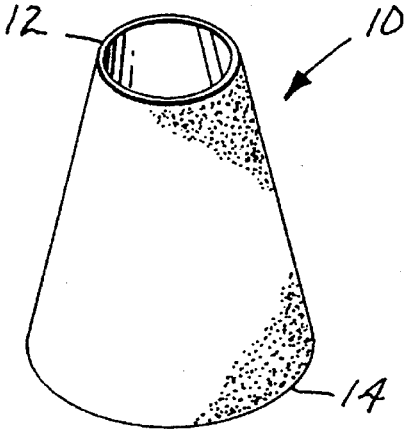
FIG. 1 is a perspective view of a coated abrasive cone.
Figure 2:
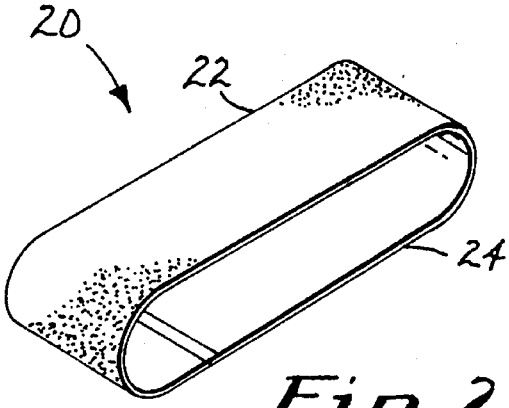
FIG. 2 is a perspective view of an endless coated abrasive belt.

The two major configurations of endless coated abrasive articles are belts and cones. FIG. 1 illustrates a coated abrasive cone. FIG. 2 illustrates a coated abrasive belt. Referring to FIG. 1, a coated abrasive sheet cut into the shape of a trapezoid, has two ends abutted to form a joint. Splicing the thus abutted ends results in a continuous belt 10 having a first circumferential boundary 12 and a second circumferential boundary 14. The diameter of the first circumferential boundary 12 is smaller than the diameter of the second circumferential boundary 14. Referring to FIG. 2, a coated abrasive sheet, cut into the shape of a parallelogram, has two ends abutted to form a joint. Splicing the thus abutted ends results in a continuous belt 20 having a first circumferential boundary 22 and a second circumferential boundary 24. The diameter of the first circumferential boundary 22 and the diameter of the second circumferential boundary 24 are substantially equal.

Figure 3:
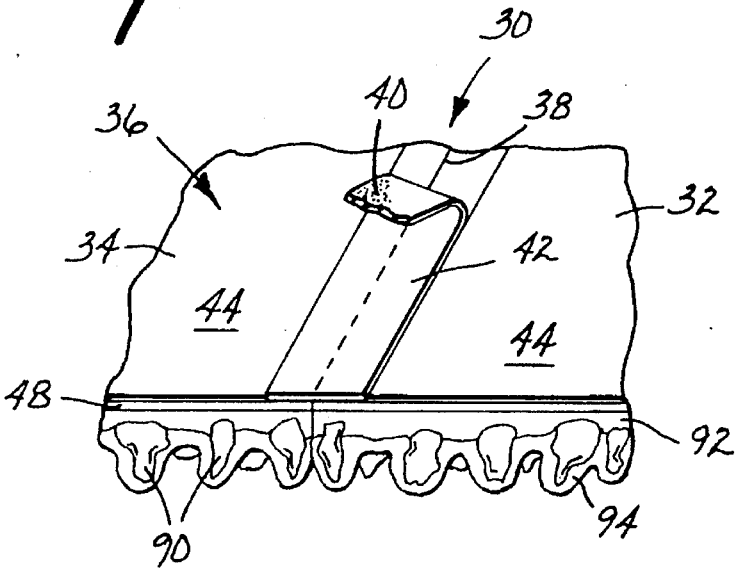
FIG. 3 is a perspective view of the back side of a coated abrasive article having a butt splice.
Figure 4:
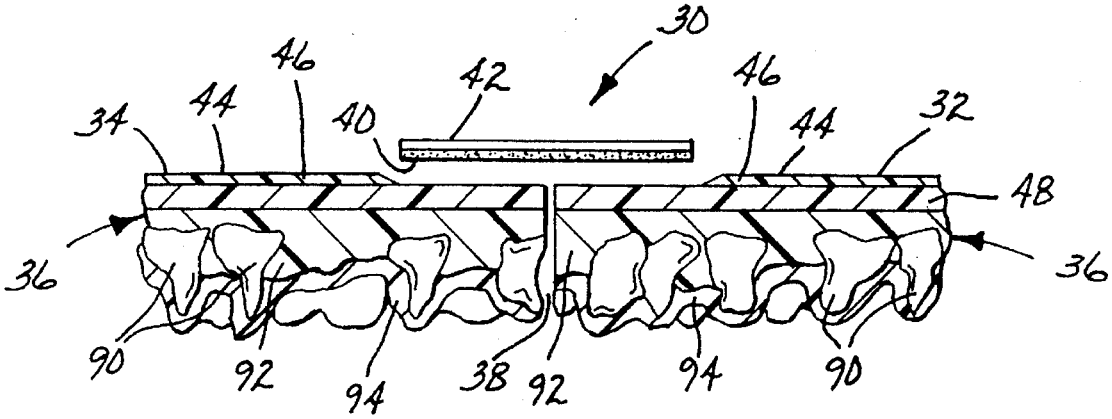
FIG. 4 is a sectional view of a coated abrasive article having a butt splice.

Referring to FIGS. 3 and 4, a butt splice 30 comprises two ends 32, 34 of a coated abrasive sheet material 36 joined to form a joint 38. A splice adhesive 40 and a splice medium 42 are placed over joint 38 to hold ends 32, 34 together. The butt splice 30 preferably does not significantly increase the thickness of the resulting coated abrasive article made from coated abrasive sheet material 36.

Coated abrasive sheet material 36 is first cut to the desired length, preferably ranging from about 15 cm to about 1,000 cm, more preferably from about 30 cm to about 500 cm. The cut ends 32, 34 of coated abrasive sheet 36 are cut at an angle from about 10° to about 170°, preferably from about 35° to about 155°, relative to the working direction of the belt. The two ends 32, 34 are preferably cut such that the sum of the angles add up to 180°, so that (1) there is a minimal gap between the two ends, and (2) that the two ends, when spliced, do not overlap significantly. It is preferred that the spliced ends 32, 34 not overlap at all. It is most preferable that one angle be 65° and the other angle be 115°.

After the sheet 36 is cut, it is preferred that the back side 44 of the cut ends 32, 34 be scuffed. Although scuffing is not always necessary for paper-backed or film-backed coated abrasives, it is employed frequently with cloth-backed coated abrasives. In scuffing, part of the backing treatment 46 from the back side 44 of the coated abrasive sheet 36 is removed, either by sandblasting or abrading away the treatment material. Scuffing increases the surface area of the region of the back side 44 designated for adhesion and removes backing treatment material, thereby resulting in increased adhesion between the splice adhesive 40 and the backing 48. Removal of part of the backing treatment 46 can also result in a more uniform belt thickness in the area of the splice 30.

Next, the radiation curable splice adhesive 40 is applied onto the scuffed portion of the back side 44 in the vicinity of the two cut ends 32, 34. The adhesive 40 can be applied over the scuffed portion by conventional techniques, such as, for example, brush coating, roll coating, spray coating, knife coating, or die coating. Preferably, the adhesive 40 is applied by brush coating. The splice adhesive 40 is applied to the scuffed portion of each cut end 32, 34, usually covering from about 0.25 to about 3 cm along the entire width of each cut end. The thickness of the layer of splice adhesive 40 preferably ranges from about 25 to about 300 micrometers, more preferably from about 100 to about 150 micrometers. If the thickness of the layer of adhesive is too low, there will be poor adhesion and the splice can fail.

The radiation curable splice adhesive 40 can be any adhesive that can be partially cured or partially polymerized by being exposed to radiation energy. Representative examples of these adhesives include: acrylated urethanes, acrylated epoxies, acrylated polyesters, aminoplast derivatives having pendant unsaturated carbonyl groups, ethylenically unsaturated compounds, isocyanurate derivatives having at least one pendant acrylate group, isocyanate derivatives having at least one pendant acrylate group, and mixtures and combinations thereof. Acrylated urethanes are diacrylate esters of hydroxy terminated NCO extended polyesters or polyethers. Examples of commercially available acrylated urethanes include those having the tradenames UVITHANE 782 (Morton Thiokol Chemical) and EBECRYL 6600, EBECRYL 8400, and EBECRYL 8805 (Radcure Specialties). The acrylated epoxies are diacrylate esters, such as the diacrylate esters of bisphenol A epoxy resin. Examples of commercially available acrylated epoxies include those having the tradenames EBECRYL 3500, EBECRYL 3600, and EBECRYL 3700 (Radcure Specialties). Examples of commercially available acrylated polyesters include those having the tradename PHOTOMER 5018 (Henkel Corp.). The aminoplast derivatives have at least 1.1 pendant alpha, beta unsaturated carbonyl groups per molecule. They are further described in U.S. Pat. No. 4,903,440, incorporated herein by reference. Ethylenically unsaturated compounds suitable for this invention include monomeric or polymeric compounds that contain atoms of carbon, hydrogen, and oxygen, and optionally nitrogen and the halogens. Oxygen and nitrogen atoms are generally present in ether, ester, urethane, amide, and urea groups. Examples of such compounds are further described in U.S. Pat. No. 4,903,440, previously incorporated herein by reference. The isocyanate derivatives having at least one pendant acrylate group and the isocyanate derivatives having at least one pendant acrylate group are described in U.S. Pat. No. 4,652,274, incorporated herein by reference. The above-mentioned splice adhesives can be cured via a free-radical polymerization mechanism.

The splice adhesive can be a radiation curable epoxy resin as described in U.S. Pat. No. 4,318,766, incorporated herein by reference. This type of splice adhesive is preferably cured by ultraviolet radiation. This epoxy resin cures via a cationic polymerization mechanism.

If the splice adhesive is cured by ultraviolet radiation, it is preferred to include a photoinitiator to initiate the free-radical polymerization. Examples of photointiators suitable for this purpose include organic peroxides, azo compounds, quinones, benzophenones, nitroso compounds, acryl halides, hydrazones, mercapto compounds, pyrylium compounds, triacrylimidazoles, bisimidazoles, haloalkyltriazines, benzoin ethers, benzil ketals, thioxanthones, and acetophenone derivatives. The preferred photoinitiator is 2,2-dimethoxy-1,2-diphenyl-1-ethanone.

If the splice adhesive is cured by visible radiation, it is preferred to include a photoinitiator to initiate the free-radical polymerization. Examples of preferred photoinitiators for curing by visible radiation are set forth in U.S. Pat. No. 4,735,632, incorporated herein by reference.

It is also within the scope of this invention to employ heat to cure the radiation curable splice adhesives, if care is taken to employ appropriate curing conditions.

After the splice adhesive 40 is applied to the scuffed portions of the two cut ends 32, 34, these ends are abutted to form a joint 38. Alternatively, the two cut ends 32, 34 can be abutted before the splice adhesive 40 is applied. The gap between the two cut ends 32, 34 should be minimal, and they preferably should not overlap.

Next, a splice medium 42 is placed over the joint 38. The splice medium 42 can be any type of reinforcing material, such as a nonwoven fabric, a woven fabric, a stitchbonded fabric, a polymeric film, a reinforced polymeric film, or treated versions or combinations thereof. It is preferred that the splice medium 42 have a strength substantially equal to that of the strength of the backing 48 of the coated abrasive article. Splice media typically have a width ranging from about 1 to about 5 cm.

Polymeric films are preferred for splice media. Representative examples of polymeric films suitable for splice media include polyester film, polyamide film (nylon), polypropylene film, polyethylene film, and polyimide film. Polyester film is preferred. Typically, the polymeric film is primed to increase the adhesion to the splice adhesive. An example of a primer for polymeric films is polyurethane. In addition, polymeric films can be strengthened with some type of reinforcing fiber, such as, for example, fibers of glass, polyester, steel, carbon, polyamide, or aramid, such as "Kevlar" fiber, commercially available from E. I. DuPont de Nemours and Company, Wilmington, Del.

Finally, the splice adhesive 40 is cured by radiation energy to form the endless coated abrasive article. Three major types of radiation sources can be used: ionizing radiation, ultraviolet radiation, and visible radiation. Ionizing radiation, e.g., electron beam radiation, is preferably applied at a dosage level of 0.1 to 30 Mrad, more preferably 1 to 10 Mrad. Additionally, the electron potential should be in the range of 10 to 5,000 KeV, preferably 100 to 300 KeV. Ultraviolet radiation is non-particulate radiation having a wavelength ranging from about 200 to about 700 nanometers, more preferably from about 250 to about 400 nanometers. Visible light radiation is non-particulate radiation having a wavelength ranging from about 400 to about 800 nanometers, more preferably from about 400 to about 550 nanometers. Ultraviolet radiation is the preferred source of radiation energy if the splice medium is a polymeric film. The preferred curing conditions for ultraviolet radiation are approximately 125 watts/cm with an exposure time of 1 to 10 seconds, preferably 3 to 5 seconds. The rate of curing with a given level of radiation varies according to the thickness of the medium and the adhesive as well as the density and nature of the adhesive composition. It should be noted that ultraviolet radiation or visible light radiation can be effectively used only if the splice medium is transparent to ultraviolet radiation or visible light radiation, respectively.

The splice 30 typically utilizes the full width of the coated abrasive sheet 36; the sheet 36 is then converted into the desired smaller widths.

In an alternative embodiment, the splice adhesive can be coated on the splice medium. The radiation curable adhesive can be applied to one side of the splice medium by conventional means, such as roll coating, brush coating, spray coating, or die coating. The coated abrasive sheet is cut, scuffed, if desired, and the cut ends of the coated abrasive sheet abutted and joined as in the embodiment described previously. Then, the splice medium is placed over the joint such that the radiation curable adhesive contacts portions of both cut ends of the coated abrasive sheet. The splice adhesive is then cured by exposure to a source of radiation energy. This is a very useful embodiment, based on ease of manufacture, as it is much easier to continuously coat a long sheet of splice media than it is to coat the cut ends of coated abrasive sheets.

Figure 5:
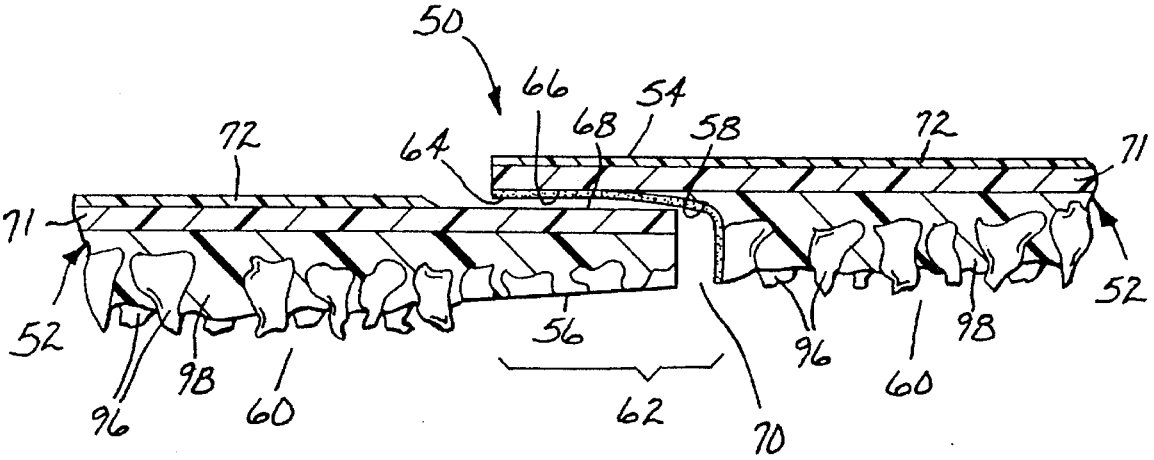
FIG. 5 is a sectional view of a coated abrasive article having a lap splice.

The components of a lap splice are shown in FIG. 5. In order to make a lap splice 50, the coated abrasive sheet 52 is first cut to the desired length in a manner similar to that used in the manufacture of butt splices. The cut ends 54, 56 of the coated abrasive sheet 52 are cut at an angle from about 10° to about 170°, preferably from about 35° to about 155°, relative to the working direction of the belt. The two cut ends 54, 56 are preferably cut such that the sum of the angles add up to 180°. It is most preferable that one angle be 65° and the other angle be 115°. After the sheet is cut, it is preferred that the back side of one of the cut ends 56 be scuffed, for the reasons and in the manner previously described with respect to butt splices. A portion of the front side 60 of the coated abrasive sheet 52 adjacent to cut end 54 is preferably ground by means of another abrasive article to remove at least a portion of the grain material. A portion of the front side 62 of the coated abrasive sheet 52 adjacent to cut end 56 is preferably skived to remove at least a portion of the grain material. The radiation curable splice adhesive 64 can be coated on the ground portion 58 of the abrasive grain bearing side 66 of one of the cut ends 54. Alternatively, the radiation curable splice adhesive can be coated on the portion of the back side 68 of the cut end 56 that is to join with the ground portion 58 of the front side 66 of the other cut end 54. It is preferable that the appropriate portions of both cut ends 54, 56 be coated with adhesive 64. The splice adhesive 64 will typically be applied by brush coating, roll coating, or spray coating. Brush coating is the preferred method. The radiation curable adhesive 64 can be selected from those described for preparing butt splices.

The two cut ends 54, 56 are then overlapped to form a joint 70. A force is applied, typically by means of a press, such that there is firm contact between the two overlapped ends 54, 56. The joint 70 is then exposed to a source of radiation energy to cure the splice adhesive 64. If the backing 71 of the coated abrasive article is paper, vulcanized fiber, film, cloth, or combinations thereof, or if the backing 71 or backing treatment 72 is made of some other material that is not transparent to ultraviolet or visible radiation, it is preferred that the source of radiation energy be an electron beam to assure that the splice adhesive 64 is fully cured. Curing conditions for electron beam are the same as described previously.

It is preferred for both butt and lap splices that heat, or pressure, or both be applied before the joint is exposed to the source of radiation energy to provide better penetration of the splice adhesive into the backing of the coated abrasive article. It is most preferred to utilize both heat and pressure. The heat and pressure can be applied together by means of a conventional heated press. The temperature typically ranges from 30° C. to 120° C., preferably from 50° C. to 120° C. If the temperature is too high, the heat can degrade the backing of the coated abrasive article. The pressure typically ranges from about 50 to about 5000 psi, preferably from 150 to 2500 psi. The joint typically stays in the press from about 5 to about 50 seconds, preferably from 10 to 20 seconds. If the heat and pressure are applied separately, it is preferable to apply heat first, followed by pressure.

Figure 6:
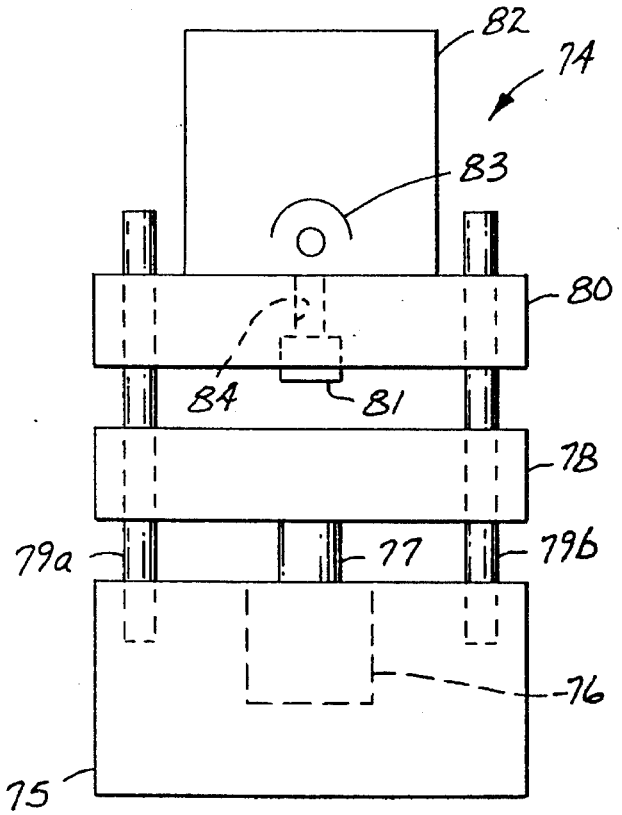
FIG. 6 is a side view of a radiation source and a press useful for preparing a butt splice.

Heat, pressure, and radiation energy can be applied simultaneously, especially when the radiation energy is either ultraviolet radiation energy or visible radiation energy. Simultaneous application of heat, pressure, and radiation energy is difficult for an electron beam on account of the shielding requirements. Referring to FIG. 6, a joint (not shown) is placed in a press 74 such that the back side of the coated abrasive article faces upward. Press 74 includes a cabinet 75 having a hydraulic cylinder 76 and a hydraulic ram 77 which renders a lower plate 78 movable in a vertical direction. Lower plate 78 is capable of moving vertically on connector bars 79a and 79b. An upper plate 80 of the press 74 includes a quartz window 81 that is directly over the joint. A source 82 of ultraviolet or visible radiation having a bulb 83 is placed over quartz window 81. The radiation energy is transmitted through a slot 84 and then through a quartz window 81 and into the splice adhesive to cure the adhesive. For this type of arrangement, the temperature preferably ranges from 50° C. to 120° C., the pressure preferably ranges from 175 to 2500 psi, and the exposure to ultraviolet radiation preferably ranges from about 5 to about 15 seconds at 300 watts/inch.

The splice adhesive can be an acrylated urethane. Representative examples of commercially available acrylated urethanes include those having the trade designations UVITHANE 782 (Morton Thiokol Chemical) and EBECRYL 6600, EBECRYL 8400, or EBECRYL 8805 (Radcure Specialties). It has been found that the acrylated urethane adhesive performs exceptionally well. The structural formula of a typical acrylated urethane adhesive is set forth below:

$$CH_2{=}\overset{R^3}{\overset{|}{C}}{-}\overset{O}{\overset{\|}{C}}OCH_2CH_2O{-}\overset{O}{\overset{\|}{C}}NHR^1NH\overset{O}{\overset{\|}{C}}OR^2O{-}\overset{O}{\overset{\|}{C}}NHR^1NH\overset{O}{\overset{\|}{C}}OCH_2CH_2O\overset{O}{\overset{\|}{C}}{-}\overset{R^3}{\overset{|}{C}}{=}CH_2$$

where $R^1$ represents the residue of a diisocyanate, preferably having 6 or more carbon atoms, $R^2$ represents a polyol backbone, e.g., polyethylene oxide $$\left(CH_2CH_2O\right)_n,$$

polypropylene oxide $$\left(CH_2\overset{CH_3}{\overset{|}{C}}HO\right)_n,$$

polytetramethylene oxide $$\left(CH_2CH_2CH_2CH_2O\right)_n,$$

a polyester polyol, a polycarbonate polyol, $R^3$ represents H or $-CH_3$, and n represents a number from 1 to about 20.

The components of the endless coated abrasive articles are well known in the art. The backing, for example, can be formed of paper, cloth, vulcanized fiber, polymeric film, treated versions thereof, or any other backing material conventionally used in coated abrasive articles. It should be noted, however, that certain backing materials are not transparent to ultraviolet or visible radiation; if these types of backings, e.g., cloth, are used, curing of the splice adhesive in a lap splice must be carried out by electron beam radiation or by thermal energy. If the backing is transparent to ultraviolet or visible radiation, the splice adhesive can be cured by means of ultraviolet, visible, or electron beam radiation, or by thermal energy. The abrasive grains can also be of any type conventionally used in coated abrasives. For example, they can be made of flint, garnet, aluminum oxide, ceramic aluminum oxide, alumina zirconia, diamond, silicon carbide, and multigrain granules, or mixtures thereof. The concentration of the abrasive grains on the backing is also conventional. The abrasive grains can be oriented or unoriented, depending upon the requirements of the particular coated abrasive article. The coated abrasive articles of this invention will typically have a first binder coat, i.e., a make coat, to secure the abrasive grains to the backing. In addition, there may be an optional second binder coat, i.e., a size coat, which further reinforces the abrasive grains. The make coat and size coat may be made of the same material or of different materials. Examples of binder coat materials include phenolic resins, epoxy resins, acrylate resins, urea-formaldehyde resins, melamine-formaldehyde resins, hide glue, and combinations thereof. These binder coat materials may also include additives known in the art.

In FIGS. 3 and 4, the abrasive grains are designated by reference numeral 90, the make coat is designated by reference numeral 92, and the size coat is designated by reference numeral 94. In FIG. 5, the abrasive grains are designated by reference numeral 96, and the make coat is designated by reference numeral 98. A size coat is not shown.

One of the major advantages of the splices of this invention is that they provide a satisfactory level of breaking load per unit width.

In addition to their usefulness for joining the cut ends of coated abrasive sheets, the splices of this invention can be used to join the individual segments of endless segmented coated abrasive articles. Segmented coated abrasive belts are useful for abrading surfaces having great width.

Figure 7A:
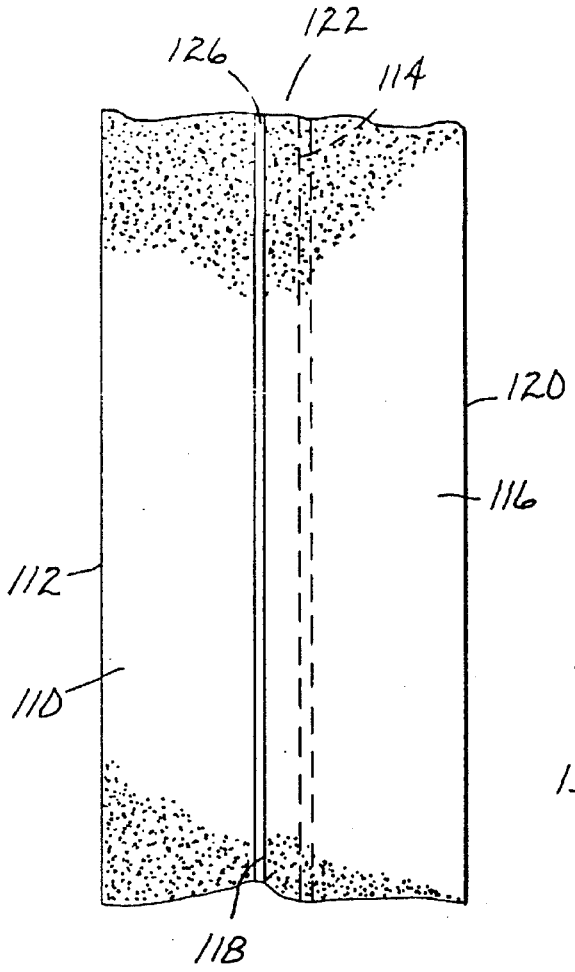
FIG. 7A shows a plan view of a segmented abrasive article having a lap splice.
Figure 8A:
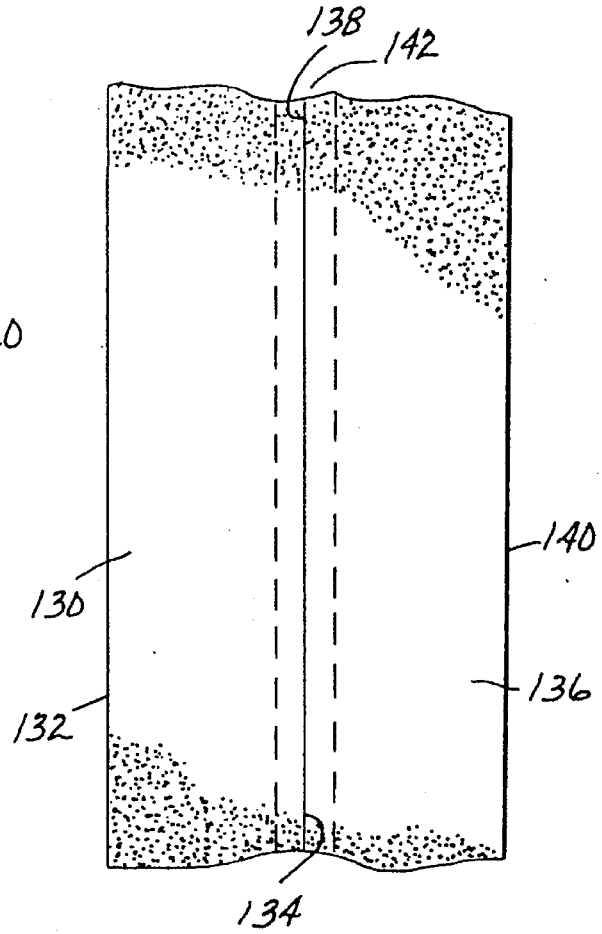
FIG. 8A shows a plan view of a segmented article having a butt splice.
Figure 7B:
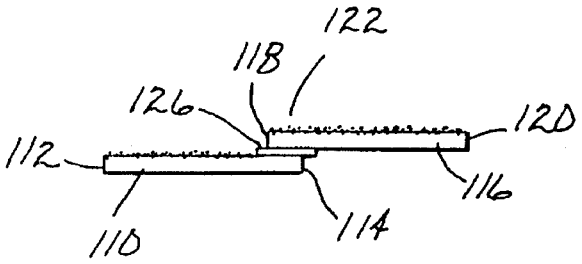
FIG. 7B is a sectional view of a segmented abrasive article having a lap splice.
Figure 8B:
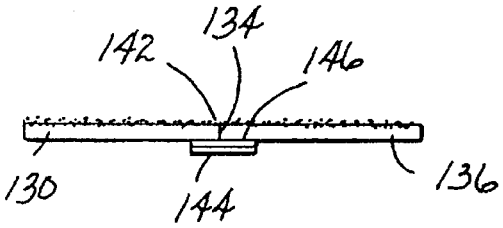
FIG. 8B is a sectional view of a segmented abrasive article having a butt splice.

In order to form splices for the segments of endless segmented abrasive articles, the splices, either butt splices or lap splices, can be formed in the manner described previously. However, instead of cut ends of a single sheet being joined, the elongated sides of elongated sheets of coated abrasive material are joined. The splice media for the elongated splices for segmented coated abrasives must be sufficient in number and in length to adequately secure the separate segments. Referring to FIGS. 7A and 7B, elongated coated abrasive sheet 110 having elongated sides 112, 114 and elongated coated abrasive sheet 116 having elongated sides 118, 120 are overlapped to form a joint 122. Joint 122 can be spliced by means of adhesive 126 in the manner shown in FIG. 5 and in accordance with the description corresponding to FIG. 5. Referring to FIGS. 8A and 8B, elongated coated abrasive sheet 130 having elongated sides 132, 134, and elongated coated abrasive sheet 136 having elongated sides 138, 140 are abutted to form a joint 142. Joint 142 can be spliced by means of splice medium 144 and adhesive 146 in the manner shown in FIG. 4 and in accordance with the description corresponding to FIG. 4.

The following non-limiting examples will further illustrate the invention. Examples 1–3 compare various sources of radiation energy.

EXAMPLE 1

Coated abrasive sheet material (Grade 50 Regal Resin Bond Cloth, commercially available from Minnesota Mining and Manufacturing Company, St. Paul, Minn.) was cut in such a way that one cut end had an angle of 65° relative to the working direction of the belt, and the other cut end had an angle of 115° relative to the working direction of the belt. A portion of the back side located in the vicinity of each cut end was scuffed by sandblasting. The area of these portions was approximately one-half of the width of the splice medium. The two cut ends were abutted to form a joint. A radiation curable splice adhesive (splice adhesive A) was brushed over the scuffed area. Splice adhesive A consisted of 80 parts by weight acrylated urethane (UVITHANE 782, Morton Thiokol Chemical) 20 parts by weight N-vinyl pyrrolidone, and 2 parts by weight 2,2-dimethoxy-1,2-diphenyl-1-ethanone (IRGACURE 651, a photoinitiator commercially available from Ciba-Geigy). The joint was then covered with a splice medium (splice medium A). Splice medium A had a width of 0.75 in. Splice medium A was a polyurethane primed polyester film containing polyester reinforcing fibers, commercially available from Sheldahl Co. The sample was then placed in a heated press of the type illustrated in FIG. 6. First, both heat and pressure were applied to the joint. The bottom press bar had been preheated to 120° C., and a pressure of approximately 15 kg/cm$^2$ was applied for five seconds. Then pressure, heat, and radiation energy were applied simultaneously. The source of radiation energy was an ultraviolet lamp, a D bulb from Fusion Company, and the exposure time was five seconds at 300 watts/inch. The thus-formed splice was tested for breaking load per unit width by means of an Instron tensile tester. Then the endless coated abrasive belts (7.6 cm by 335 cm) were tested under severe grinding conditions to fully evaluate the strength of the splice. The severe grinding test was the same as that described in U.S. Pat. No. 4,927,431 under the designation of Test Procedure Two. The results are set forth in Tables I and II.

EXAMPLE 2

Coated abrasive sheet material (Grade 50 Regal Resin Bond Cloth, commercially available from Minnesota Mining and Manufacturing Company) was cut in such a way that one cut end had an angle of 65° relative to the working direction of the belt and the other cut end had an angle of 115° relative to the working direction of the belt. A portion of the back side located in the vicinity of each cut end was scuffed by sandblasting. The area of these portions was approximately one-half the width of the splice medium. The two cut ends were abutted to form a joint. A radiation curable splice adhesive (splice adhesive B) was brushed over the scuffed area. Splice adhesive B consisted of 80 parts by weight acrylated urethane (UVITHANE 782) and 20 parts by weight n-vinyl pyrrolidone. The joint was then covered with a splice medium A. Splice medium A had a width of 0.75 in. The sample was then placed in a heated press of the type illustrated in FIG. 6. First both heat and pressure were applied to the joint. The bottom press bar had been preheated to 120° C., and a pressure of approximately 15 kg/cm$^2$ was applied for five seconds. Then the joint was exposed to a source of electron beam radiation having an energy level of 4 Mrad at 200 Kev. The thus-formed splice was then tested for breaking load per unit width in the same manner as was used in Example 1. The results are set forth in Table II.

EXAMPLE 3

Coated abrasive sheet material (Grade 50 Regal Resin Bond Cloth, commercially available from Minnesota Mining and Manufacturing Company) was cut in such a way that one cut end had an angle of 65° relative to the working direction of the belt and the other cut end had an angle of 115° relative to the working direction of the belt. A portion of the back side located in the vicinity of each cut end was scuffed by sandblasting. The area of these portions was approximately one-half the width of the splice medium. The two cut ends were abutted to form a joint. A radiation curable splice adhesive (splice adhesive C) was brushed over the scuffed area. Splice adhesive C consisted of 80 parts by weight acrylated urethane (UVITHANE 782, Morton Thiokol Chemical), 20 parts by weight n-vinyl pyrrolidone, and 2 parts by weight visible light photoinitiator (1 part by weight chlorothioxanthone, 1 part by weight ethyl 4-dimethylaminobenzoate). The joint was then covered with splice medium A. Splice medium A had a width of 0.75 in. The sample was then placed in a heated press of the type illustrated in FIG. 6. First both heat and pressure were applied to the joint. The bottom press bar had been preheated to 120° C. and a pressure of approximately 15 kg/cm$^2$ was applied for five seconds. Then pressure, heat, and radiation energy were applied simultaneously. The source of radiation energy was visible light, a V bulb from Fusion Company, and the exposure time was five seconds at 300 watts/inch. The thus-formed splice was then tested for breaking load per unit width. The results are set forth in Table II.

COMPARATIVE EXAMPLE A

Coated abrasive sheet material (Grade 50 Regal Resin Bond Cloth, commercially available from Minnesota Mining and Manufacturing Company) was cut in such a way that one cut end had an angle of 65° relative to the working direction of the belt and the other cut end had an angle of 115° relative to the working direction of the belt. A portion of the back side located in the vicinity of each cut end was scuffed by sandblasting. The area of these portions was approximately one-half the width of the splice medium. The two cut ends were abutted to form a joint, and a thermally curable polyurethane adhesive was brushed over the scuffed area. The polyurethane adhesive was substantially similar to that described in U.S. Pat. No. 4,011,358 (Example 1), 100 parts by weight adipic acid-ethylene glycol-polyester-diisocyanate reaction product having hydroxy functionality, as a 22% solids solution in ethyl acetate, and 7 parts by weight triphenyl methane triisocyanate, as a 20% solution in methylene chloride. The polyurethane adhesive contained 15% by weight solids in ethyl acetate solvent. The solvent flashed off in approximately 20 minutes. The joint was then covered with splice medium A and placed in a heated press. Splice medium A had a width of 0.75 in. The joint was exposed to a temperature of 120° C. for 14 seconds and a pressure of 15 kg/cm$^2$ for three seconds. The thus-formed splice was tested in the same manner as was used in Example 1. The results are set forth in Tables I and II.

Additionally, the sheet materials made in Example 1 and Comparative Example A were converted into a 2.54 cm by 17.8 cm segments in which the splices were in the middle of the segments. These segments were then tested by means of a flex test. The flex test consisted of wrapping the segments around, at a 90° angle, a 0.64 cm diameter bar at a tension of 20 kg. The segments were moved 2.54 cm in one direction and then 2.54 cm in the opposite direction to make a cycle. The number of cycles were measured until the splice broke. The flex test results for Example 1 and Comparative Example A are set forth in Table I.

TABLE I

| Example | Severe grinding test (no. of bars abraded) | Flex test (no. of cycles) |
|---|---|---|
| 1 | 42 | 181 |
| Comparative A | 44 | >2000 |

TABLE II

| Example | Breaking load per unit width (kgf/cm) |
|---|---|
| 1 | 42 |
| 2 | 27.6 |
| 3 | 28.6 |
| Comparative A | 45 |

EXAMPLES 4–10

The splices for Examples 4–10 compare splice adhesives made from different chemical compositions. The coated abrasive articles of these examples were made and tested in the same manner as was the coated abrasive article of Example 1 except that the UVITHANE 782 adhesive in splice adhesive A was replaced with an equal amount by weight of a different radiation curable adhesive for each example. The results are set forth in Table III.

TABLE III

| Example | Adhesive | Breaking load per unit width (kgf/cm) |
|---|---|---|
| 4 | TMDI(MA)2[1] | 36 |
| 5 | TATHEIC[2] | 31 |
| 6 | EBECRYL 8805[3] | 34 |
| 7 | EBECRYL 8400[3] | 39 |
| 8 | EBECRYL 6600[3] | 42 |
| 9 | AMP[4] | 36 |
| 10 | 5018[5] | 42 |

[1]TMDI(MA)2 was dimethacryloxy ester of trimethyhexamethylenediisocyanate.
[2]TATHEIC was triacrylate of tris(hydroxy ethyl)isocyanurate.
[3]EBECRYL 8805, EBECRYL 8400, and EBECRYL 6600 were acrylated urethanes, commercially available from Radcure Specialties.
[4]AMP was an aminoplast resin having pendant acrylate functional groups. AMP was made in a similar manner to Preparation 4 of U.S. Pat. No. 4,903,440.
[5]5018 was an acrylated polyester resin, commercially available from Henkel Corporation under the trade designation Photomer 5018.

EXAMPLES 11–14

The splices for Examples 11–14 compare splice adhesive made from different chemical compositions. The coated abrasive articles of these examples were made and tested in the same manner as was the coated abrasive article of Example 1 except that the N-vinyl pyrrolidone in splice adhesive A was replaced with an equal amount by weight of a different radiation curable diluent for each example. The results are set forth in Table IV.

TABLE IV

| Example | Diluent | Breaking load per unit width (kgf/cm) |
|---|---|---|
| 11 | TMPTA[1] | 39 |
| 12 | NPGDA[2] | 41 |
| 13 | IBA[3] | 42 |
| 14 | NVP[4] | 37 |

[1]TMPTA was trimethylol propane triacrylate.
[2]NPGDA was neopentyl glycol diacrylate.
[3]IBA was isobornyl acrylate.
[4]NVP was N-vinyl pyrrolidone.

EXAMPLES 15–18

The splices for Examples 15–18 were made and tested for breaking load per unit width in the same manner as were those of Example 1, except different coated abrasive products were employed. These coated abrasive products were also tested according to the flex test. Example 15 employed a grade 180 Three-M-ite Resin Bond Cloth JE weight coated abrasive product; Example 16 employed a grade 100 Three-M-ite Resin Bond film coated abrasive product; Example 17 employed a grade 120 Three-M-ite Resin Bond Cloth X weight coated abrasive product; and Example 18 employed a grade 100 Production Resin Bond paper coated abrasive product. All of the coated abrasive products were commercially available from Minnesota Mining and Manufacturing Company. The results are set forth in Table V.

Comparative Examples B, C, D, and E

The splices for Comparative Examples B, C, D, and E were made and tested for breaking load per unit width in the same manner as was that of Comparative Example A, except that different coated abrasive products were employed. These coated abrasive products were also subjected to the flex test. Comparative Example B employed a grade 180 Three-M-ite Resin Bond Cloth JE weight coated abrasive product; Comparative Example C employed a grade 100 Three-M-ite Resin Bond film coated abrasive product; Comparative Example D employed a grade 120 Three-M-ite Resin Bond Cloth X weight coated abrasive product; and Comparative Example E employed a grade 100 Production Resin Bond paper coated abrasive product. All of the coated abrasive products were commercially available from Minnesota Mining and Manufacturing Company. The results are set forth in Table V.

TABLE V

| Example. | Flex text (no. of cycles) | Breaking load per unit width (kgf/cm) |
|---|---|---|
| 15 | 600 | 30 |
| 16 | 20 | 14 |
| 17 | 1777 | 26 |
| 18 | 20 | 24 |
| Comparative B | 1049 | 31 |
| Comparative C | 1560 | 16 |
| Comparative D | 9252 | 28 |
| Comparative E | 5 | 25 |

EXAMPLE 19

The splice for Example 19 was made and tested for breaking load per unit width in the same manner as was used in Example 1, except that splice adhesive A was brushed onto splice medium A and not onto the backing of the coated abrasive article. The test results are set forth in Table VI.

TABLE VI

| Example | Breaking load per unit width (kgf/cm) |
|---|---|
| 19 | 41 |
| Comparative A | 40 |

EXAMPLE 20

The splice for Example 20 was made and tested for breaking load per unit width in the same manner as was that of Example 1, except that a different process for preparing the splice was used. First the joint was placed in a press identical to that used in Example 1. The bottom press bar had been preheated to 120° C., and a pressure of approximately 15 kg/cm$^2$ was applied for 10 seconds. Then the joint was removed from the press and irradiated with ultraviolet light for five seconds at 300 watts/inch. The source of ultraviolet energy was the same as that used in Example 1. The results are set forth in Table VII.

TABLE VII

| Example | Breaking load per unit width (kgf/cm) |
|---|---|
| 20 | 28 |
| Comparative A | 34.5 |

EXAMPLE 21 AND COMPARATIVE EXAMPLE F

Example 21 illustrates a method for preparing a coated abrasive belt. Grade 100 Regal Resin Bond Cloth Y weight coated abrasive sheet, 2.54 cm by 5 cm, was cut in the form of a parallelogram. One cut end had a 65° angle relative to the working direction of the belt and the other cut end had a 115° angle relative to the working direction of the belt. Splice adhesive A, the same adhesive as was used in Example 1, was brushed onto the coated abrasive backing in the same manner as was used in Example 1. The two cut ends were abutted and splice medium A was placed over the splice adhesive. Splice medium A had a width of 0.75 in. Next the joint was clamped to a cylindrically-shaped glass tube. The joint was exposed to XENON lamp (Xenon Corporation) having an energy level of 200 watts/cm$^2$ for 12 seconds to cure the splice adhesive. The belt was then placed on a hand held air grinder designed for small coated abrasive belts. The grinder operated at 6,000 rpm. The product was evaluated by grinding the edge of a carbon steel sheet until the splice failed. Comparative Example F was a commercially available belt from Minnesota Mining and Manufacturing Company sold under the trade designation grade 100 Regal Resin Bond Cloth coated abrasive belt. The results are set forth in Table VIII.

TABLE VIII

| Example | Time to fail (min) |
|---|---|
| 21 | 10 |
| Comparative F | 2 |

EXAMPLES 22–24

The splices for Examples 22–24 illustrate splice adhesives made from different chemical compositions. The coated abrasive articles of these examples were made and tested in the same manner as was the coated abrasive article of Example 1, except that a different splice adhesive formulation was used. For Example 22, the splice adhesive consisted of 60 parts by weight acrylated urethane (UVITHANE 782), 40 parts by weight N-vinyl pyrrolidone, and 2 parts by weight 2,2-dimethoxy-1,2-dephenyl-1-ethone. For Example 23, the splice adhesive consisted of 60 parts by weight acrylated urethane (UVITHANE 782), 40 parts by weight N-vinyl pyrrolidone, and 1 part by weight 2,2-dimethoxy-1,2-diphenyl-1-ethone. For Example 24, the splice adhesive consisted of 60 parts by weight acrylated urethane (UVITHANE 782), 40 parts by weight N-vinyl pyrrolidone, 2 parts by weight 2,2-dimethoxy-1,2-diphenyl-1-ethone, and 0.5 part by weight benzoyl peroxide. In these examples, the upper press bar of the press was heated to a temperature of 120° C. The breaking load per unit width of the resulting splices were measured, and the results are set forth in Table IX.

TABLE IX

| Example | Breaking load per unit width (kgf/cm) |
|---|---|
| 22 | 46 |
| 23 | 45 |
| 24 | 49 |
| Comparative A | 50 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. Method of preparing an endless coated abrasive article having a butt splice, said method comprising the steps of:

(1) providing a sheet bearing abrasive grains on one major surface thereof;

(2) cutting said sheet to a desired length in such a manner that said sheet has two ends;

(3) abutting the cut ends of said sheet to form a joint;

(4) applying a layer of radiation curable adhesive onto a portion of each of said cut ends of said sheet on the major surface thereof not bearing abrasive grains;

(5) placing a splice medium over said joint so that said splice medium is in contact with said layers of radiation curable adhesive; and (6) curing said radiation curable adhesive by means of radiation energy, whereby a butt splice comprising said splice medium, said adhesive, and said joint is formed.

2. The method of claim 1, wherein said radiation curable adhesive is selected from the group consisting of acrylated urethanes, acrylated epoxies, acrylated polyesters, aminoplast derivatives having pendant unsaturated carbonyl groups, ethylenically unsaturated compounds, isocyanurate derivatives having at least one pendant acrylate group, isocyanate derivatives having at least one pendant acrylate group, and mixtures and combinations thereof.

3. The method of claim 1, wherein the source of said radiation energy is ultraviolet radiation.

4. The method of claim 1, wherein the source of said radiation energy is electron beam.

5. The method of claim 1, wherein the source of said radiation energy is visible radiation.

6. The method of claim 1, wherein said splice medium is selected from the group consisting of nonwoven fabrics, woven fabrics, stitchbonded fabrics, polymeric films, reinforced polymeric films, and treated versions and combinations thereof.

7. The method of claim 1, wherein said splice medium is a reinforced polymeric film.

8. The method of claim 1, wherein said joint and said splice medium are subjected to pressure at the same time that the radiation curable adhesive is being cured.

9. The method of claim 8, further including the step of applying heat to said joint and said splice medium at the same time that the radiation curable adhesive is being cured.

10. The method of claim 1, wherein said joint and said splice medium are subjected to pressure prior to the curing step.

11. The method of claim 10, further including the step of applying heat to said joint and said splice medium prior to the curing step.

12. The method of claim 1, further including the step of scuffing the portion of each of said cut ends of said sheet on the major surface thereof not bearing abrasive grains prior to applying said layer of radiation curable adhesive thereto.

13. The method of claim 1, further including the step of curing said radiation curable adhesive by means of thermal energy.

14. The method of claim 1 wherein said butt splice has a breaking load per unit width of at least 14 kgf/cm.

15. Method of preparing an endless coated abrasive article having a butt splice, said method comprising the steps of:

(1) providing a sheet bearing abrasive grains on one major surface thereof;

(2) cutting said sheet to a desired length in such a manner that said sheet has two ends;

(3) abutting the cut ends of said sheet to form a joint;

(4) applying a layer of radiation curable adhesive to a surface of a splice medium;

(5) placing said splice medium over said joint such that said adhesive bearing surface of said splice medium is in contact with said cut ends of said sheet on the major surface thereof not bearing abrasive grains; and (6) curing said radiation curable adhesive by means of radiation energy, whereby a butt splice comprising said splice medium, said adhesive, and said joint is formed.

16. The method of claim 15, wherein said radiation curable adhesive is selected from the group. consisting of acrylated urethanes, acrylated epoxies, acrylated polyesters, aminoplast derivatives having pendant unsaturated carbonyl groups, ethylenically unsaturated compounds, isocyanurate derivatives having at least one pendant acrylate group, isocyanate derivatives having at least one pendant acrylate group, and mixtures and combinations thereof.

17. The method of claim 15, wherein the source of said radiation energy is ultraviolet radiation.

18. The method of claim 15, wherein the source of said radiation energy is electron beam.

19. The method of claim 15, wherein the source of said radiation energy is visible radiation.

20. The method of claim 15, wherein said splice medium is selected from the group consisting of nonwoven fabrics, woven fabrics, stitchbonded fabrics, polymeric films, reinforced polymeric films, treated versions of the foregoing, and combinations thereof.

21. The method of claim 15, wherein said splice medium is a reinforced polymeric film.

22. The method of claim 15, wherein said joint and said splice medium are subjected to pressure at the same time that the radiation curable adhesive is being cured.

23. The method of claim 22, further including the step of applying heat to said joint and said splice medium at the same time that the radiation curable adhesive is being cured.

24. The method of claim 15, wherein said joint and said splice medium are subjected to pressure prior to the curing step.

25. The method of claim 15, further including the step of applying heat to said joint and said splice medium prior to the curing step.

26. The method of claim 15, further including the step of scuffing the portion of each of said cut ends of said sheet on the major surface thereof not bearing abrasive grains prior to applying said layer of radiation curable adhesive thereto.

27. The method of claim 15, further including the step of curing said radiation curable adhesive by means of thermal energy.

28. The method of claim 15 wherein said butt splice has a breaking load per unit width of at least 14 kgf/cm.

29. Method of preparing an endless coated abrasive article having a lap splice, said method comprising the steps of:

(1) providing a sheet bearing abrasive grains on one major surface thereof:

(2) cutting said sheet to a desired length in such a manner that said sheet has two ends;

(3) applying a layer of radiation curable adhesive to a portion of the abrasive grain bearing surface of one cut end or to a portion of the surface of the other cut end not bearing abrasive grains or to both of said portions;

(4) overlapping the cut ends of said sheet to form a joint such that the adhesive bearing portion of one cut end contacts the other cut end; and (5) curing said radiation curable adhesive by means of radiation energy, whereby a lap splice comprising said joint and said adhesive is formed.

30. The method of claim 29, wherein said radiation curable adhesive is selected from the group consisting of acrylated urethanes, acrylated epoxies, acrylated polyesters, aminoplast derivatives having pendant unsaturated carbonyl groups, ethylenically unsaturated compounds, isocyanurate derivatives having at least one pendant acrylate group, isocyanate derivatives having at least one pendant acrylate group, and mixtures and combinations thereof.

31. The method of claim 29, wherein the source of said radiation energy is electron beam.

32. The method of claim 29, wherein said joint is subjected to pressure at the same time that the splice adhesive is being cured.

33. The method of claim 32, further including the step of applying heat to said joint at the same time that the radiation curable adhesive is being cured.

34. The method of claim 29, wherein said joint is subjected to pressure prior to the curing step.

35. The method of claim 34, further including the step of applying heat to said joint prior to the curing step.

36. The method of claim 29, wherein the step of curing said radiation curable adhesive by means of thermal energy.

37. The method of claim 29, further including the step of grinding a portion of the abrasive grain bearing surface of one cut end.

38. The method of claim 29, further including the step of skiving a portion of the abrasive grain bearing surface of one cut end.

39. The method of claim 29, further including the step of scuffing the portion of one of said cut ends of said sheet on the major surface thereof not bearing abrasive grains prior to applying said layer of radiation curable adhesive thereto.

40. The method of claim 29 wherein said lap splice has a breaking load per unit width of at least 14 kgf/cm.

41. Method of joining two elongated coated abrasive sheets along the elongated sides thereof to form a butt splice, said method comprising the steps of:

(1) providing two elongated sheets each of which bears abrasive grains on one major surface thereof;

(2) abutting said sheets along the elongated sides thereof so that said major surfaces bearing abrasive grains are both facing the same direction to form a joint;

(3) applying a layer of radiation curable adhesive onto the portions of the elongated side of each of said sheets that are abutting to form said joint, said adhesive applied on a portion of the major surfaces of said sheets not bearing abrasive grains;

(4) placing at least one splice medium over said joint so that said at least one splice medium is in contact with said layers of radiation curable adhesive; and (5) curing said radiation curable adhesive by means of radiation energy, whereby a butt splice comprising said at least one splice medium, said adhesive, and said joint is formed.

42. The method of claim 41 wherein said butt splice has a breaking load per unit width of at least 14 kgf/cm.

43. Method of joining two elongated coated abrasive sheets along the elongated sides thereof to form a butt splice, said method comprising the steps of:

(1) providing two elongated sheets each of which bears coated abrasive grains on one major surface thereof;

(2) abutting said sheet along the elongated sides thereof so that said major surfaces bearing abrasive grains are both facing the same direction to form a joint;

(3) applying a layer of radiation curable adhesive to a surface of at least one splice medium;

(4) placing said at least one splice medium over said joint such that said adhesive bearing surface of said at least one splice medium is in contact with said elongated sides of said sheets on the major surfaces thereof not bearing abrasive grains; and (5) curing said radiation curable adhesive by means of radiation energy, whereby a butt splice comprising said at least one splice medium, said adhesive, and said joint is formed.

44. The method of claim 43 wherein said butt splice has a breaking load per unit width of at least 14 kgf/cm.

45. Method of joining two elongated coated abrasive sheets along the elongated sides thereof to form a lap splice, said method comprising the steps of:

(1) providing two elongated sheets each of which bears coated abrasive grains on one major surface thereof;

(2) applying a layer of radiation curable adhesive to a portion of the elongated side of the abrasive grain bearing surface of one sheet or to a portion of the elongated side of the surface of the other sheet not bearing abrasive grains or to both of said portions;

(3) overlapping the elongated sides of said sheets to form a joint such that the adhesive bearing portion of one elongated side of one sheet is in contact with the elongated side of the other sheet and the surfaces bearing abrasive grains are both facing the same direction; and (4) curing said radiation curable adhesive by means of radiation energy, whereby a lap splice comprising said joint said adhesive is formed.

46. The method of claim 45, wherein the source of said radiation energy is electron beam.

47. The method of claim 45 wherein said lap splice has a breaking load per unit width of at least 14 kgf/cm.

* * * * *